US012473672B2

(12) United States Patent
Ikenaga

(10) Patent No.: US 12,473,672 B2
(45) Date of Patent: Nov. 18, 2025

(54) SURFACE COVERING MATERIAL

(71) Applicant: Asahi Kasei Kabushiki Kaisha, Tokyo (JP)

(72) Inventor: Hideo Ikenaga, Tokyo (JP)

(73) Assignee: Asahi Kasei Kabushiki Kaisha, Tokyo (JP)

( * ) Notice: Subject to any disclaimer, the term of this patent is extended or adjusted under 35 U.S.C. 154(b) by 0 days.

(21) Appl. No.: 18/281,011

(22) PCT Filed: Mar. 22, 2022

(86) PCT No.: PCT/JP2022/013177
§ 371 (c)(1),
(2) Date: Sep. 8, 2023

(87) PCT Pub. No.: WO2022/202815
PCT Pub. Date: Sep. 29, 2022

(65) Prior Publication Data

US 2024/0035211 A1 Feb. 1, 2024

(30) Foreign Application Priority Data

Mar. 24, 2021 (JP) ..... 2021-049849

(51) Int. Cl.
*D04B 21/20* (2006.01)

(52) U.S. Cl.
CPC ..... *D04B 21/20* (2013.01); *D10B 2403/033* (2013.01); *D10B 2505/08* (2013.01)

(58) Field of Classification Search
CPC ..... D04B 21/10; D04B 21/12; D04B 21/14; D04B 21/16; D04B 21/20;
(Continued)

(56) References Cited

U.S. PATENT DOCUMENTS

2002/0157429 A1* 10/2002 Matsumoto ..... D04B 21/10 66/195
2003/0033838 A1* 2/2003 Ikenaga ..... D04B 21/16 66/196
(Continued)

FOREIGN PATENT DOCUMENTS

CN 103991256 A 8/2014
CN 104060366 A 9/2014
(Continued)

OTHER PUBLICATIONS

International Preliminary Report on Patentability and Written Opinion issued in corresponding International Patent Application No. PCT/JP2022/013177 dated Oct. 5, 2023.
(Continued)

*Primary Examiner* — Aiying Zhao
(74) *Attorney, Agent, or Firm* — Morgan, Lewis & Bockius LLP

(57) ABSTRACT

Provided is a surface covering material such as a sheet for a seat in a vehicle or as furniture, or upholstery for a vehicle, said surface covering material having good cooling and anti-stuffiness properties, while being able to inhibit the creation of fluff even if the surface is rubbed by hard protrusions such as the hook part of a hook-and-loop fastener. The surface covering material of the present invention is configured from a three-dimensional knit that includes a front knit fabric, a back knit fabric, and a connecting layer composed of connecting yarn that connects the front knit fabric and the back knit fabric, said surface covering material being characterized in that the outside surface of the front knit fabric is set to be a surface that comes into contact with a human body, and the stitch density of the front knit fabric is 11,500-20,000, inclusive.

11 Claims, 1 Drawing Sheet

(58) Field of Classification Search
CPC ..... D10B 2403/033; D10B 2403/0213; D10B 2403/0223; D10B 2505/08
USPC ..... 66/195, 196
See application file for complete search history.

(56) References Cited

U.S. PATENT DOCUMENTS

| | | | | |
|---|---|---|---|---|
| 2003/0101776 | A1* | 6/2003 | Shirasaki | D04B 21/12 66/196 |
| 2004/0154343 | A1* | 8/2004 | Ogata | D04B 21/18 66/170 |
| 2007/0261173 | A1* | 11/2007 | Schlussel | D04B 21/14 5/725 |
| 2010/0229606 | A1* | 9/2010 | Ikenaga | B60N 2/70 66/196 |
| 2011/0272993 | A1 | 11/2011 | Kilincsoy et al. | |
| 2015/0191142 | A1 | 7/2015 | Youn et al. | |
| 2017/0305314 | A1 | 10/2017 | Miyoshi et al. | |

FOREIGN PATENT DOCUMENTS

| | | | | |
|---|---|---|---|---|
| CN | 104411872 | A | | 3/2015 |
| CN | 106715192 | A | | 5/2017 |
| CN | 106757773 | A | | 5/2017 |
| CN | 210169588 | U | | 3/2020 |
| DE | 102005029755 | A1 | | 12/2006 |
| JP | 2002-348762 | A | | 12/2002 |
| JP | 2004-183118 | A | | 7/2004 |
| JP | 2004-204372 | A | | 7/2004 |
| JP | 2004-229894 | A | | 8/2004 |
| JP | 2006-104620 | A | | 4/2006 |
| JP | 2007-044386 | A | | 2/2007 |
| JP | 2007-195777 | A | | 8/2007 |
| JP | 2009-262407 | A | | 11/2009 |
| JP | 2010043387 | A | * | 2/2010 |
| JP | 2010-275650 | A | | 12/2010 |
| JP | 2012-213858 | A | | 11/2012 |
| JP | 2014-088632 | A | | 5/2014 |
| JP | 7259143 | B2 | | 4/2023 |
| KR | 10-2003-0092033 | A | | 12/2003 |
| KR | 10-2007-0031414 | A | | 3/2007 |
| KR | 10-2017-0044775 | A | | 4/2017 |
| KR | 20170044775 | A | * | 4/2017 |
| WO | 2010/078663 | A2 | | 7/2010 |
| WO | 2022/202815 | A1 | | 9/2022 |

OTHER PUBLICATIONS

International Search Report issued in corresponding International Patent Application No. PCT/JP2022/013177 dated Jun. 7, 2022.
Decision to Grant issued in corresponding Japanese Patent Application No. 2022-578734 dated Mar. 28, 2023.
Supplementary European Search Report issued in European Patent Application No. 22775598.0 dated Apr. 9, 2024.
Office Action issued in European Patent Application No. 22775598.0 dated Feb. 18, 2025.

* cited by examiner

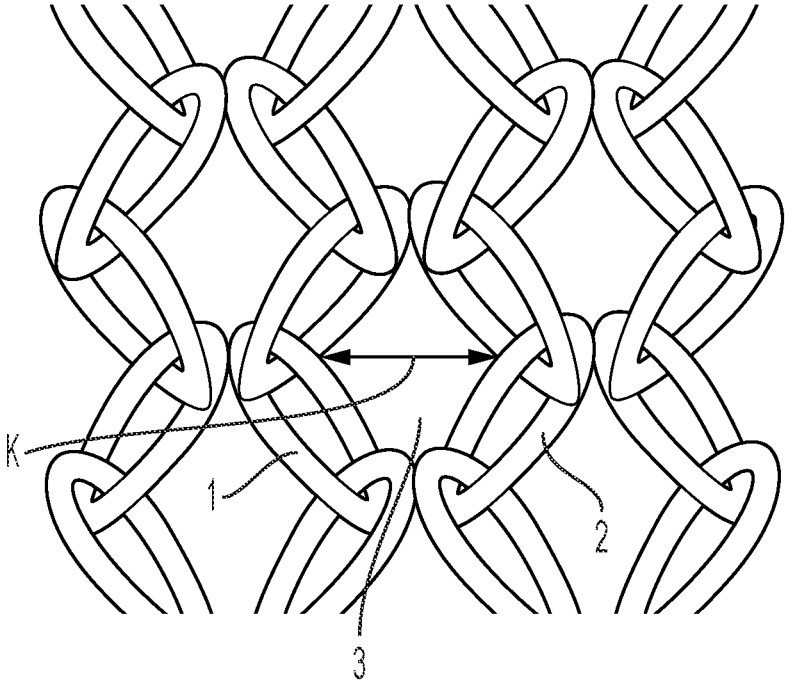
K
1
2
3

SURFACE COVERING MATERIAL

FIELD

The present invention relates to a surface covering material.

BACKGROUND

Three-dimensional knitted fabrics constructed with front/back double-layer knitted fabrics and connecting thread that connects the double-layer knitted fabrics employ monofilaments as the connecting thread and thus have a cushioning property in the thickness direction, while they also ensure high air permeability through the mesh structure of the front and back knitted fabrics, and consequently they are widely used as cool and stuffiness-resistant cushion materials for a variety of articles including seat and beddings.

When a three-dimensional knitted fabric is used in a surface covering material for a vehicle or furniture seat or for vehicle upholstery, however, the mesh-like structure with a high open area ratio on the surface of the three-dimensional knitted fabric results in high air permeability but also creates a surface that lacks durability such as wear resistance that is required for a surface covering material.

One strategy for obtaining wear resistance for three-dimensional knitted fabric surfaces, as disclosed in PTL 1, is to form a three-dimensional knitted fabric wherein the knitted fabric on the front layer has a compact texture with an open area percentage of 35% or lower using multifilament yarn having a monofilament fineness of 1 to 10 decitex, and the stitch density of the knitted fabric on the front layer is 4000 to 11,000, to obtain a three-dimensional knitted fabric having a soft surface hand quality and a soft elastic feel, excellent Taber abrasion resistance, and low change in outer appearance even with prolonged use.

PTL 2 discloses a dense knitted texture with the connecting thread having a total cross-sectional area in a specified range within a 6.54 $cm^2$ area of the three-dimensional knitted fabric, and with an optimal relationship between the apparent diameter of the multifilament and the diameter of the monofilament in the same stitch of the front layer knitted fabric, and an open area ratio of 35% or lower for the front layer knitted fabric, whereby a three-dimensional knitted fabric is obtained with reduced monofilament glare and roughness and a smooth surface tactile property, even when using relatively thick monofilaments that increase the repulsion-like feel.

PTL 3 discloses a three-dimensional knitted fabric with low surface roughness and low skin irritation, wherein the total cover factor of the three-dimensional knitted fabric is within a specified range, the mesh open area of the surface is at or below a prescribed value, and the variation MMD in the frictional coefficient of the surface is within a specified range.

CITATION LIST

Patent Literature

[PTL 1] Japanese Unexamined Patent Publication No. 2004-229894

[PTL 2] Japanese Unexamined Patent Publication No. 2004-183118

[PTL 3] Japanese Unexamined Patent Publication No. 2007-044386

SUMMARY

Technical Problem

Although the three-dimensional knitted fabric of PTL 1 exhibits improved Taber abrasion resistance, it is not designed in consideration of a surface condition for inhibiting napping when rubbed by hard protrusions such as the hook sections of hook-and-loop fasteners, or in consideration of the condition of surface recesses, and therefore its ability to reduce napping caused by rubbing on protrusions has been less than sufficient.

Although the three-dimensional knitted fabrics of PTL 2 and PTL 3 have dense knitted textures on the surface, they are not designed in consideration of providing a surface condition that inhibits napping when rubbed by hard protrusions such as the hook sections of hook-and-loop fasteners, or in consideration of the condition of surface recesses, and therefore their ability to reduce napping has been less than sufficient.

In light of the current level of the prior art, the object of the present invention is to solve the problem of the prior art by providing a surface covering material for seats for a vehicle or furniture, or for vehicle upholstery, which has a high cooling property and stuffiness resistance, while also inhibiting napping generation even when the surface is rubbed by hard protrusions such as the hook sections of hook-and-loop fasteners.

Solution to Problem

As a result of much research conducted with the goal of solving the aforementioned problem, the present inventors have completed this invention upon finding, unexpectedly, that the problem can be solved if a surface covering material comprising a three-dimensional knitted fabric constructed of a front layer knitted fabric, a back layer knitted fabric and connecting thread connecting the front layer knitted fabric and back layer knitted fabric, has a specified range for the stitch density of the front layer knitted fabric of the three-dimensional knitted fabric.

Specifically, the present invention is as follows.

[1] A surface covering material constructed from a three-dimensional knitted fabric that includes a front layer knitted fabric, a back layer knitted fabric, and a connecting layer comprising connecting thread connecting the front layer knitted fabric and back layer knitted fabric, wherein the outer surface of the front layer knitted fabric is the side that contacts with the human body, and the stitch density of the front layer knitted fabric is 11,500 to 20,000.

[2] The surface covering material according to [1] above, wherein the stitch density of the front layer knitted fabric is 13,000 to 19,000.

[3] The surface covering material according to [2] above, wherein the stitch density of the front layer knitted fabric is 14,000 to 19,000.

[4] The surface covering material according to any one of [1] to [3] above, wherein the open area ratio at a depth of 250 μm inward from the outer surface of the front layer knitted fabric of the three-dimensional knitted fabric is 15% to 70%.

[5] The surface covering material according to any one of [1] to [4] above, wherein the air permeability from the connecting layer side, between the front layer knitted fabric and back layer knitted fabric of the three-dimensional knitted fabric, toward the front layer knitted fabric, is 33 cc/cm$^2$/sec or greater.

[6] The surface covering material according to [5] above, wherein the air permeability from the connecting layer side, between the front layer knitted fabric and back layer knitted fabric of the three-dimensional knitted fabric, toward the front layer knitted fabric, is 40 cc/cm$^2$/sec or greater.

[7] The surface covering material according to [6] above, wherein the air permeability from the connecting layer side, between the front layer knitted fabric and back layer knitted fabric of the three-dimensional knitted fabric, toward the front layer knitted fabric, is 50 cc/cm$^2$/sec or greater.

[8] The surface covering material according to any one of [1] to [7] above, wherein the air permeability from the connecting layer side, between the front layer knitted fabric and back layer knitted fabric of the three-dimensional knitted fabric, toward the front layer knitted fabric, is 400 cc/cm$^2$/sec or lower.

[9] The surface covering material according to any one of [1] to [8] above, wherein the number of stitches of connecting thread knitted into the front layer knitted fabric of the three-dimensional knitted fabric is ¼ to ½ of the total number of stitches in the front layer knitted fabric.

[10] The surface covering material according to any one of [1] to [9] above, wherein the front layer knitted fabric of the three-dimensional knitted fabric includes a mesh structure made of a thread removal arrangement, the sizes of the openings of the mesh structure being 0.3 mm to 2.5 mm.

[11] The surface covering material according to any one of [1] to [10] above, wherein the front layer knitted fabric of the three-dimensional knitted fabric is not piled.

[12] The surface covering material according to any one of [1] to [11] above, wherein the thickness of the three-dimensional knitted fabric is 2.5 mm to 12 mm.

[13] The surface covering material according to any one of [1] to [12] above, which is for a seat.

[14] The surface covering material according to any one of [1] to [13] above, which is for a seat, and wherein the air permeability from the connecting layer side, between the front layer knitted fabric and back layer knitted fabric of the three-dimensional knitted fabric, toward the front layer knitted fabric, is 400 cc/cm$^2$/sec or lower, and the front layer knitted fabric of the three-dimensional knitted fabric is not piled.

Advantageous Effects of Invention

The surface covering material of the invention can exhibit a high cooling property and stuffiness resistance, and can also inhibit generation of napping even when the surface is rubbed with a hard protrusion such as the hook section of a hook-and-loop fastener.

BRIEF DESCRIPTION OF DRAWINGS

FIG. 1 is a schematic diagram showing the sizes of openings in a mesh structure.

DESCRIPTION OF EMBODIMENTS

The invention will now be explained in detail using an embodiment.

One embodiment of the invention is a surface covering material constructed from a three-dimensional knitted fabric that includes a front layer knitted fabric, a back layer knitted fabric, and a connecting layer comprising connecting thread connecting the front layer knitted fabric and back layer knitted fabric, wherein the outer surface of the front layer knitted fabric is the side that contacts with the human body, and the stitch density of the front layer knitted fabric is 11,500 to 20,000.

The surface covering material of the embodiment includes a three-dimensional knitted fabric constructed of a front layer knitted fabric, a back layer knitted fabric and connecting thread connecting the front layer knitted fabric and back layer knitted fabric. The three-dimensional knitted fabric is knitted with a double Raschel warp knitting machine or double circular knitting machine, the knitting machine gauge preferably being 18 to 28 gauge.

The three-dimensional knitted fabric forming the surface covering material of the embodiment must have a stitch density of 11,500 to 20,000 for the front layer knitted fabric serving as the side of the surface covering material that contacts with the human body.

The term "stitch density" used herein is an index representing the stitching density of the front layer knitted fabric, represented by the following formula:

$$\text{Stitch density } M = N \times \sqrt{D}$$

{where N is the number of stitches in the front layer knitted fabric per 2.54 cm-square, and D is the total fineness (decitex) of the fiber forming one stitch of the front layer knitted fabric}. The phrase "total fineness of the fiber forming one stitch of the front layer knitted fabric" indicates the total fineness of only the fiber forming the stitches, and excludes the fineness of the connecting thread, and excludes non-stitch-forming fibers such as inlay stitching. The "side that contacts with the human body" indicates the side that is to be in contact with the human body when the surface covering material is used as a seat for vehicle or furniture, or for vehicle upholstery, and in the case of a seat it is the seating surface.

If the stitch density is less than 11,500, the protrusions such as the hook sections of a hook-and-loop fastener are easy to catch onto individual filaments of the stitches on the surface layer, tending to result in breakage of the individual filaments and formation of napping. If the stitch density is greater than 20,000, on the other hand, the likelihood for protrusions such as hook-and-loop fastener hook sections to catch onto the individual filaments of the stitches on the surface layer will be lower, but the reduced air permeability of the front layer knitted fabric will also tend to prevent migration of heat by air convection currents or migration of humidity, thus resulting in a reduced refreshing feel and greater stuffiness during contact with the surface covering material while sitting.

From the viewpoint of inhibiting napping by protrusions and obtaining a more satisfactory refreshing feel and reduced stuffiness, the preferred range for the stitch density is 13,000 to 19,000 and more preferably 14,000 to 19,000.

To obtain a stitch density of 11,500 to 20,000 it is preferred to adjust the fineness of the fibers used in the front layer knitted fabric, the knitting machine gauge, the machine course, the knitted texture and the width insertion rate during finishing including heat setting, the width expansion rate, the overfeed rate and the underfeed rate.

The material for the fibers used in the front layer knitted fabric is not restricted, and it may be a single type of material or multiple materials compounded by mixed fiber processing combined twisting, mixed spinning or mixed knitting, although long fibers of polyethylene terephthalate are preferred from the viewpoint of raw yarn strength and light fastness. From the viewpoint of increasing withdrawal resistance of the individual filaments to inhibit pulling of the individual filaments from the knitted fabric surface by protrusions such as hook sections of a hook-and-loop fastener, polyethylene terephthalate fibers are preferably false twisted yarn, interlaced yarn or twisted threads.

The fineness of the fibers used for the front layer knitted fabric is preferably a fineness of 100 decitex to 350 decitex, for optimization of the stitch density. From the same viewpoint, the total fineness per single stitch composed of the fibers of the front layer knitted fabric is preferably 150 decitex to 800 decitex.

When the fibers used in the front layer knitted fabric are multifilaments, the single fiber fineness is preferably 1 decitex to 6 decitex, and more preferably 3 decitex to 6 decitex, which provide higher monofilament strength.

The fibers used for the connecting thread are preferably monofilaments. When monofilaments are used as the connecting thread, the fineness is preferably 30 decitex to 300 decitex and more preferably 50 decitex to 250 decitex, in order to inhibit protrusion of the monofilaments onto the knitted fabric surface and maintain a satisfactory cushioning property.

If the monofilaments protrude out from the knitted fabric surface of the three-dimensional knitted fabric they will tend to catch onto protrusions such as hook sections of a hook-and-loop fastener, and therefore preferably the stitches of the fibers forming the front layer knitted fabric hold down the stitches of the monofilaments so that the monofilaments do not protrude onto the outer surface of the front layer knitted fabric (that is, the side of the surface covering material that contacts with the human body), for which purpose the ratio of the fineness D2 (decitex) of the monofilaments with respect to the total fineness D1 (decitex) of each stitch composed of fibers forming the front layer knitted fabric preferably satisfies the following relational expression:

$$D1/D2 \geq 3.$$

In the three-dimensional knitted fabric forming the surface covering material of the embodiment, preferably the knitted texture of the front layer knitted fabric is a mesh structure having a thread removal arrangement such as 1-in, 1-out or 2-in, 2-out when supplying yarn from the guide bar using at least two combs. With a mesh structure, however, protrusions such as hook sections tend to catch onto recesses produced on the knitted fabric surface. In a three-dimensional knitted fabric forming the surface covering material of the embodiment, preferably the open area ratio is 15% to 70% at a depth of 250 μm inward from the outer surface (uppermost surface layer). The open area ratio is calculated to include not only the openings of the mesh structure but also the parts with deep recesses at sections other than the mesh structure of the front layer knitted fabric. An open area ratio of 70% or lower will help prevent protrusions from catching onto individual filaments in the recesses, while an open area ratio of 15% or higher will provide adequate air permeability for the front layer knitted fabric, aiding movement of heat and humidity and providing a refreshing feel and reduced stuffiness. A more preferred range for the open area ratio at a depth of 250 μm from the uppermost surface layer is 20% to 60%, with 20% to 50% being even more preferred.

The sizes of the openings in the mesh structure of the front layer knitted fabric are preferably 0.3 mm to 2.5 mm, and more preferably 0.3 mm to 2.2 mm, to ensure air permeability for the front layer knitted fabric and to reduce the likelihood that projections such as hooks are caught in the openings of the mesh structure.

The openings in the mesh structure, for this embodiment, are voids formed in stitch rows running in the warp direction forming the front layer knitted fabric, where adjacent stitches create open gaps of 0.3 mm or larger in the course direction (weft direction) in all or some of the courses, the sizes of the openings in the mesh structure representing the lengths connected by two points selected so that the linear distance on a horizontal line in the course direction (weft direction) is longest in each of the openings in the mesh structure. FIG. 1 is a schematic view showing a mesh structure opening 3 of size K (mm) formed between adjacent stitches 1 and 2. The thread may also be inlay stitched in a manner crossing the openings in the mesh structure.

The surface covering material of the embodiment has an air permeability of preferably 33 cc/cm$^2$/sec or greater, more preferably 40 cc/cm$^2$/sec or greater and even more preferably 50 cc/cm$^2$/sec or greater, for air passing from the side of the connecting layer between the front layer knitted fabric and back layer knitted fabric of the three-dimensional knitted fabric (hereunder also referred to simply as "connecting layer") toward the front layer knitted fabric, from the viewpoint of allowing movement of heat and humidity from the human body while sitting or during contact to obtain satisfactory coolness and stuffiness resistance. The air permeability is preferably 400 cc/cm$^2$/sec or less.

As used herein, the phrase "air permeability from the connecting layer side, between the front layer knitted fabric and back layer knitted fabric of the three-dimensional knitted fabric, toward the front layer knitted fabric" means the air permeability of the three-dimensional knitted fabric measured under the suction conditions of the air permeability test method (Method A) of JIS L1096, with a three-dimensional knitted fabric test piece size of 15 cm-square set on the opening of the air permeability tester with the front layer knitted fabric facing downward, and a 3 mm-thick, 20 cm-square silicon rubber plate placed over the outer surface of the back layer knitted fabric to shield air from passing through the back layer knitted fabric, while allowing the air to enter through the four sided cross-section of the three-dimensional knitted fabric and pass through the connecting layer to permeate the front layer knitted fabric.

In order to increase the air permeability from the connecting layer side toward the front layer knitted fabric of the three-dimensional knitted fabric, it is especially effective to reduce pressure loss during passage of air through the connecting layer, and for this purpose it is preferred to relatively reduce the number of connecting threads forming the connecting layer of the three-dimensional knitted fabric, with respect to the number of stitches in the front layer knitted fabric. From the same viewpoint, the number of stitches of connecting thread woven into the front layer knitted fabric of the three-dimensional knitted fabric for this embodiment is preferably ¼ to ½ of the total number of stitches in the front layer knitted fabric (i.e. 0.25 to 0.50). The total number of stitches in the front layer knitted fabric is the number of stitches in a 2.54 cm-square piece of front side knitted fabric and can be calculated as the product of the number of courses/2.54 cm and the number of wales/2.54 cm.

The air permeability from the back layer knitted fabric through the front layer knitted fabric of the three-dimensional knitted fabric, as generally measured according to the air permeability test method (Method A) of JIS L1096, is preferably 60 cc/cm$^2$/sec or greater, more preferably 70 cc/cm$^2$/sec or greater and even more preferably 90 cc/cm$^2$/sec or greater. The air permeability from the back layer knitted fabric through the front layer knitted fabric is more preferably 60 cc/cm$^2$/sec or greater, as a seat surface covering material to be used in combination with a cushion member incorporating a ventilation system.

The fibers used to form the three-dimensional knitted fabric may be of any desired material, optionally with different fiber materials in combination, but 100% polyethylene terephthalate fibers are preferred for the front layer knitted fabric, connecting thread and back layer knitted fabric from the viewpoint of easier material recycling or chemical recycling. Such fibers may be undyed, but it is preferred to use raw-dyed yarn or colored yarn to reduce changes in quantity of the three-dimensional knitted fabric during dyeing. It is even more preferred to use raw-dyed yarn kneaded with a dye or the like in order to eliminate the need for a dyeing step.

The thickness of the three-dimensional knitted fabric forming the surface covering material of the embodiment may be set as desired, but it is preferably 2.5 mm or greater and more preferably 3 mm or greater, and preferably 12 mm or smaller and more preferably 8 mm or smaller, from the viewpoint of sewability and handleability of the surface covering material. The basis weight of the three-dimensional knitted fabric may also be set as desired but is preferably 400 to 1000 g/m$^2$ and more preferably 500 to 900 g/m$^2$.

When the three-dimensional knitted fabric uses colored yarn or raw-dyed yarn, the method of finishing the three-dimensional knitted fabric forming the surface covering material of the embodiment may be finishing by passing the greige through steps such as scouring and heat setting, but finishing by heat setting alone is preferred from the viewpoint of process simplification. For a three-dimensional knitted fabric wherein all of the fibers used for the connecting thread or the front and back double-layer knitted fabric are uncolored, the greige may be finished by processing by steps such as presetting, scouring, dyeing and heat setting. The front layer knitted fabric of the three-dimensional knitted fabric is preferably not piled from the viewpoint of the refreshing feel and stuffiness resistance.

The surface covering material of the embodiment can be used as a surface covering material such as a vehicle or furniture seat, or upholstery for a vehicle door trimming, ceiling, armrest or instrument panel, optionally with urethane laminated on the back side similar to conventional surface covering materials, but it is preferably used without lamination from the viewpoint of the recycling property. The surface covering material of the embodiment may be composed entirely of the three-dimensional knitted fabric, or it may be combined with another material by sewing or bonding for design purposes or functionality. The surface covering material of the embodiment is more preferably used for a seat that requires high abrasion resistance and can exhibit a more refreshing feel and greater stuffiness resistance when in contact with the human body.

EXAMPLES

The present invention will now be explained in more specific detail through the following examples and comparative examples, with the understanding that the invention is in no way limited to the examples.

The following methods were used to measure the physical properties of the three-dimensional knitted fabrics used in the following Examples.

(a) Stitch Density of Front Layer Knitted Fabric

At least 10 cm of yarn was extracted from the front layer knitted fabric of the three-dimensional knitted fabric, and the length and weight were measured while applying a load of 15 gf to the thread, to calculate the linear density of a single thread. When a single stitch of the front layer knitted fabric is formed of two or more filaments, the linear densities of each thread are totaled to measure the total fineness D (decitex). The connecting thread is not included in the measurement. Measurement according to JIS L 1013 allows the fineness of the fibers forming the stitches in the front layer knitted fabric to be measured before knitting of the three-dimensional knitted fabric. The product N of the number of courses/2.54 cm and the number of wales/2.54 cm of the three-dimensional knitted fabric is measured and the stitch density of the front layer knitted fabric is calculated by the following formula:

$$\text{Stitch density } M = N \times \sqrt{D}.$$

(b) Open Area Ratio (%) at Depth of 250 μm Inward from Outer Surface of Front Layer Knitted Fabric A VR-3000 one-shot 3D microscope by Keyence Corp. is used to observe the outer surface of the front layer knitted fabric of the three-dimensional knitted fabric at a magnification of 25× to 38×, with auto-focus and 3D measurement. A height threshold is set for a total of 0.3 to 0.5% for the cross-sectional area ratio of fibers (proportion of the area occupied by fibers) in a slice of the uppermost surface layer of the front layer knitted fabric in the obtained 3D image at an arbitrary height, and that height is used as the height of the outer surface (uppermost surface layer) of the front side knitted fabric. The total cross-sectional area ratio of fibers is then measured at a location 250 μm inward below the outer surface height, and the value of this area ratio subtracted from 100% is used as the open area ratio at a depth of 250 μm inward from the outer surface.

(c) Size (mm) of Mesh Structure Openings

Based on the 3D image taken in (b), the length of a line connecting two points in an opening of the mesh structure selected so that the linear distance on a horizontal line in the course direction (weft direction) is longest is measured, and used as the size of the openings of the mesh structure. The measurement is conducted for 20 arbitrary openings, and the average value is calculated.

(d) Air Permeability (cc/cm$^2$/sec) from Connecting Layer Toward Front Side Knitted Fabric.

An FX3300 LABOAIR IV air permeability tester by Takayama Reed Co., Ltd. is used, placing the three-dimensional knitted fabric test piece with a size of 15 cm-square on the opening of the air permeability tester with the front layer knitted fabric facing downward, a 3 mm-thick, 20 cm-square silicon rubber plate is placed over the outer surface of the back layer knitted fabric, pressing the test head of the air permeability tester from above while anchoring with a clamp, and the air permeability entering from the connecting layer of the four sided cross-section of the three-dimensional knitted fabric through the front side knitted fabric is measured under suction conditions according to the air permeability test method (Method A) of JIS L1096.

(e) Air Permeability (cc/cm$^2$/sec) from Back Layer Knitted Fabric Through Front Layer Knitted Fabric of Three-Dimensional Knitted Fabric An FX3300 LABOAIR IV air permeability tester by Takayama Reed Co., Ltd. is used to measure the air permeability from the back layer knitted fabric through the front layer knitted fabric of the three-dimensional knitted fabric, according to the air permeability test method (Method A) of JIS L1096.

(f) Napping by Hook-and-Loop Fastener (Grade)

Using a flat abrasion tester by Daiei Kagaku Seiki Mfg. Co., Ltd., a three-dimensional knitted fabric with a test piece size width of 8 cm and a length of 31 cm is placed on the flat abrasion table of a flat abrasion tester with the front layer knitted fabric facing upward, and both ends are anchored with a clamp. Magic Tape™ A8693Y.71 (length: 5 cm) by Kuraray Fastening Co., Ltd. was attached to a friction block with the hook side facing outward. A reciprocal abrasion test was carried out 5 times with the friction block set on the test piece, using a pressing load of 9.8 N including the friction block, a stroke of 14 cm and a speed of 60±10 strokes/min. Test pieces are taken in the warp direction and weft direction of the three-dimensional knitted fabric and measured, observing the state of abrasion of the test piece surface after the test and assessing the grade as follows. The assessment is made with 0.5 grade increments.

Grade 5: No napping found
Grade 4: Slight napping found
Grade 3: Clear napping found but no visible yarn breakage
Grade 2: Moderate napping with some yarn breakage or yarn "pulling"
Grade 1: Considerable napping, severe impairment of outer appearance (g) Taber Abrasion Using a Taber abrasion tester according to JASOM403 Method A (Taber rotary abrasor method), the test piece is abraded 1000 times with a CS-10 abrasive wheel under a load of 4.9 N at a speed of 70 rpm. The tested piece is observed for surface abrasion and a grade assessment is made as follows. The assessment is made with 0.5 grade increments.

Grade 5: No change in surface condition
Grade 4: Some napping
Grade 3: Extensive napping
Grade 2: Extensive napping with thin yarns
Grade 1: Yarn breakage (h) Refreshing Feel The surface covering material was spread over a urethane pad on the seat and back support section of an automobile seat, to fabricate a seat wherein the total surface of the seat for contact with the human body was made of a surface covering material made of a three-dimensional knitted fabric.

The seat was set in a temperature and humidity environment at 30° C., 50% RH, and an evaluation monitor was asked to rest for 30 minutes in the environment before sitting on the seat for 10 minutes. The refreshing feel was evaluated by the following grade assessment, based on whether or not the monitor felt hotter after 10 minutes compared to before sitting. The assessment is made with 0.5 grade increments. Five monitors participated, recording the average value for the five.

Grade 5: Very hot feel with discomfort
Grade 4: Very hot feel
Grade 3: Hot feel
Grade 2: Slightly hot feel
Grade 1: Slightly hot feel but not bothersome
Grade 0: No change (i) Stuffy Feel The seat was set in a temperature and humidity environment at 30° C., 50% RH, and an evaluation monitor was asked to rest for 30 minutes in the environment before sitting on the seat for 10 minutes, in the same manner as (h). The stuffiness was evaluated by the following grade assessment, based on whether or not the monitor felt stuffiness after 10 minutes compared to before sitting. The assessment is made with 0.5 grade increments. Five monitors participated, recording the average value for the five.

Grade 5: Extremely stuffy with discomfort
Grade 4: Very stuffy
Grade 3: Stuffy
Grade 2: Slightly stuffy
Grade 1: Slightly stuffy but not bothersome
Grade 0: No change

Examples 1 to 3, Comparative Example 1

An 18-gauge double Raschel knitting machine having 6 combs and 7 mm trick plate distance was used to supply false twisted yarn of 334 decitex, 72 filament polyethylene terephthalate fibers (black raw-dyed yarn) from two combs (L1, L2) for formation of the front layer knitted fabric, doubling the yarns in a 1-in, 1-out (L1) and 1-out, 1-in (L2) arrangement, to supply a monofilament of 110 decitex polyethylene terephthalate fibers (black raw-dyed yarn) from two combs (L3, L4) for formation of the connection part in a 1-in, 1-out (L3) and 1-out, 1-in (L4) arrangement, and to further supply false twisted yarn of 167 decitex, 36 filament polyethylene terephthalate fibers (black raw-dyed yarn) from two combs (L5, L6), for formation of the back layer knitted fabric, in an all-in array.

In the following knitted textures, the three-dimensional knitted fabric greiges were knitted in a machine course of 21 course/2.54 cm (Example 1), 24 course/2.54 cm (Example 2), 30 course/2.54 cm (Example 3) and 18 course/2.54 cm (Comparative Example 1). Each obtained greige was dry heat set at 175° C.×1 minute with 1% width expansion and a 0% overfeed rate to obtain a three-dimensional knitted fabric having the properties listed in Table 1, for use as a surface covering material.

(Knitted Texture)
L1: 1011/2322/(1-in, 1-out)
L2: 2322/1011/(1-out, 1-in)
L3: 3245/2310/(1-in, 1-out)
L4: 2310/3245/(1-out, 1-in)
L5: 0001/1110/(all-in)
L6: 2234/2210/(all-in)

Example 4

A three-dimensional knitted fabric having the properties listed in Table 1 was obtained in the same manner as Example 3, except that yarn was not supplied from L4 and the number of stitches of the connecting thread was ½ of the total number of stitches in the front layer knitted fabric, and the fabric was used as a surface covering material.

Examples 5 to 8, Comparative Example 2, 3

Three-dimensional knitted fabric greiges were knitted in a machine course of 24 course/2.54 cm (Example 5), 29 course/2.54 cm (Example 6), 34 course/2.54 cm (Example 7), 34 course/2.54 cm (Example 8), 21 course/2.54 cm (Comparative Example 2) and 36 course/2.54 cm (Comparative Example 3), with the same fibers and knitted texture as Example 1, except that false twisted yarn of 222 decitex, 48 filament polyethylene terephthalate fibers (black raw-dyed yarn) was supplied from two combs (L1, L2) for formation of the front side knitted fabric, doubling the yarns in a 1-in, 1-out (L1) and 1-out, 1-in (L2) arrangement. Each obtained greige was dry heat set at 175° C.×1 minute with 5 to 10% width insertion and a 0 to 10% overfeed rate to obtain a three-dimensional knitted fabric having the properties listed in Table 1, for use as a surface covering material.

Example 9

An 18-gauge double Raschel knitting machine having 6 combs and 6 mm trick plate distance was used to supply false twisted yarn of 334 decitex, 72 filament polyethylene terephthalate fibers (black raw-dyed yarn) from two combs (L2, L3) for formation of the front layer knitted fabric, doubling the yarns in a 2-in, 2-out (L2, L3) arrangement, to supply false twisted yarn of 167 decitex, 48 filament polyethylene terephthalate fibers (gray raw-dyed yarn) from a comb (L1) for inlay stitching of pattern thread in the front layer knitted fabric, tripling the yarns in a 2-out/1-in, 3-out/1-in, 3-out/ . . . arrangement, to supply a monofilament of 110 decitex polyethylene terephthalate fibers (black raw-dyed yarn) from one comb (L4) for formation of the connection part in a 2-in, 2-out arrangement, and to further supply false twisted yarn of 167 decitex, 36 filament polyethylene terephthalate fibers (black raw-dyed yarn) from two combs (L5, L6), for formation of the back layer knitted fabric, in an all-in array.

In the following knitted textures, the three-dimensional knitted fabric greiges were knitted in a machine course of 30 course/2.54 cm, with the pattern thread held by one stitch facing the recess of the adjacent convex ridge, and the stitch on the opposite side across the recess of the same course. Each obtained greige was dry heat set at 175° C.×1 minute with 0% width expansion and a 0% overfeed rate to obtain a three-dimensional knitted fabric having the properties listed in Table 1, for use as a surface covering material.

(Knitted Texture)

L1: 0000/4444/(2-out/1-in, 3-out/1-in, 3-out/ . . . )
L2: 1011/2344/6766/5433/(2-in, 2-out)
L3: 6766/5433/1011/2344/(2-in, 2-out)
L4: 1043/6734/(2-in, 2-out)
L5: 0001/1110/(all-in)
L6: 2234/2210/(all-in)

Example 10

An 18-gauge double Raschel knitting machine having 6 combs and 6 mm trick plate distance was used to supply false twisted yarn of 334 decitex, 72 filament polyethylene terephthalate fibers (black raw-dyed yarn) from two combs (L2, L3) for formation of the front layer knitted fabric, doubling the yarns in a 2-in, 2-out (L2) and 2-out, 2-in (L3) arrangement, to supply a monofilament of 110 decitex polyethylene terephthalate fibers (black raw-dyed yarn) from one comb (L4) for formation of the connection part in a 2-in, 2-out arrangement, and to further supply false twisted yarn of 167 decitex, 36 filament polyethylene terephthalate fibers (black raw-dyed yarn) from two combs (L5, L6), for formation of the back layer knitted fabric, in an all-in array.

In the following knitted textures, the three-dimensional knitted fabric greiges were knitted in a machine course of 30 course/2.54 cm, with the pattern thread held by one stitch facing the mesh opening, and another stitch of the same course. Each obtained greige was dry heat set at 175° C.×1 minute with 0% width expansion and a 0% overfeed rate to obtain a three-dimensional knitted fabric having the properties listed in Table 1, for use as a surface covering material.

(Knitted Texture)

L1: No yarn supplied
L2: 1011/2322/1022/4544/3233/4533/(2-in, 2-out)
L3: 4544/3233/4533/1011/2322/1022/(2-out, 2-in)
L4: 1023/1023/1032/4532/4532/4523/(2-in, 2-out)
L5: 0001/1110/(all-in)
L6: 2234/2210/(all-in)

Example 11

A three-dimensional knitted fabric was obtained having the properties listed in Table 1, in the same manner as Example 4, except for using a 18-gauge double Raschel knitting machine having 6 combs and 4.2 mm trick plate distance, for use as a surface covering material.

TABLE 1

| | | Example 1 | Example 2 | Example 3 | Example 4 | Example 5 | Example 6 | Example 7 | Example 8 | Example 9 | Example 10 | Example 11 | Comp. Example 1 | Comp. Example 2 | Comp. Example 3 |
|---|---|---|---|---|---|---|---|---|---|---|---|---|---|---|---|
| Yarn usage | Front | PET334/72 false-twisted yarn | PET334/72 false-twisted yarn | PET334/72 false-twisted yarn | PET334/72 false-twisted yarn | PET222/48 false-twisted yarn | PET222/48 false-twisted yarn | PET222/48 false-twisted yarn | PET222/48 false-twisted yarn | PET334/72 false-twisted yarn | PET334/72 false-twisted yarn | PET334/72 false-twisted yarn | PET334/72 false-twisted yarn | PET222/48 false-twisted yarn | PET222/48 false-twisted yarn |
| | Front (inserted yarn) | — | — | — | — | — | — | — | — | PET167/48 false-twisted yarn | — | — | — | — | — |
| | Connect-ing thread | PET110 | PET110 | PET110 | PET110 | PET110 | PET110 | PET110 | PET110 | PET110 | PET110 | PET110 | PET110 | PET110 | PET110 |
| | Back | PET167/36 false-twisted yarn | PET167/36 false-twisted yarn | PET167/36 false-twisted yarn | PET167/36 false-twisted yarn | PET167/36 false-twisted yarn | PET167/36 false-twisted yarn | PET167/36 false-twisted yarn | PET167/36 false-twisted yarn | PET167/36 false-twisted yarn | PET167/36 false-twisted yarn | PET167/36 false-twisted yarn | PET167/36 false-twisted yarn | PET167/36 false-twisted yarn | PET167/36 false-twisted yarn |
| Total fineness of fibers forming single stitch in front layer knitted fabric (decitex) | | 688 | 688 | 688 | 688 | 457 | 457 | 457 | 457 | 688 | 688 | 688 | 688 | 457 | 457 |
| Thickness (mm) | | 5.8 | 6.1 | 6.1 | 6.1 | 5.9 | 6.0 | 6.1 | 6.1 | 6.0 | 5.9 | 3.7 | 5.8 | 6.0 | 6.1 |
| Knit-ting density | Courses/ 2.54 cm | 23.2 | 25.1 | 31.0 | 31.0 | 25.0 | 29.9 | 35.0 | 35.6 | 31.0 | 31.0 | 31.0 | 20.0 | 23.0 | 39.0 |
| | Wales/ 2.54 cm | 20.0 | 20.0 | 19.8 | 19.8 | 22.1 | 22.0 | 22.4 | 24.5 | 20.0 | 20.0 | 19.8 | 20.1 | 22.0 | 24.5 |
| Basis weight ($g/m^2$) | | 683 | 711 | 851 | 743 | 634 | 723 | 853 | 970 | 860 | 722 | 684 | 627 | 613 | 1054 |
| Stitch density | | 12171 | 13167 | 16100 | 16100 | 11811 | 14062 | 16760 | 18646 | 16262 | 16262 | 16100 | 10544 | 10817 | 20426 |
| Open area ratio at 250 μm depth (%) | | 51.5 | 44.3 | 36.1 | 36.5 | 52 | 48.8 | 29.3 | 18.5 | 58.9 | 69.5 | 36.3 | 71.2 | 70.3 | 5.4 |
| Size of mesh structure openings (mm) | | 0.5 | 0.5 | 0.6 | 0.6 | 0.8 | 0.8 | 0.9 | 0.7 | 2.3 | 2.6 | 0.6 | 0.7 | 0.8 | 0.2 |
| Air permeability from back layer knitted fabric through front layer knitted fabric ($cc/cm^2/sec$) | | 100 | 95 | 73 | 84 | 121 | 82 | 66 | 63 | 69 | 125 | 86 | 112 | 126 | 46 |
| Air permeability from connecting layer through front layer knitted fabric ($cc/cm^2/sec$) | | 86 | 84 | 60 | 68 | 84 | 52 | 51 | 45 | 52 | 90 | 33 | 88 | 94 | 40 |
| Number of stitches of connecting thread/total number of stitches in front layer knitted fabric | | 1.0 | 1.0 | 1.0 | 0.5 | 1.0 | 1.0 | 1.0 | 1.0 | 0.5 | 0.5 | 0.5 | 1.0 | 1.0 | 1.0 |

TABLE 1-continued

| | | Example 1 | Example 2 | Example 3 | Example 4 | Example 5 | Example 6 | Example 7 | Example 8 | Example 9 | Example 10 | Example 11 | Comp. Example 1 | Comp. Example 2 | Comp. Example 3 |
|---|---|---|---|---|---|---|---|---|---|---|---|---|---|---|---|
| Napping by hook-and-loop fastener (grade) | Warp direction | 3.5 | 4.0 | 4.5 | 4.5 | 3.5 | 4.0 | 4.5 | 4.5 | 4.0 | 3.5 | 4.5 | 1.0 | 1.5 | 4.5 |
| | Weft direction | 3.0 | 3.5 | 4.0 | 4.0 | 3.0 | 3.5 | 4.0 | 4.5 | 3.5 | 3.0 | 4.0 | 1.0 | 1.5 | 4.5 |
| Taber abrasion (grade) | | 3.0 | 3.5 | 4.0 | 4.0 | 3.0 | 3.5 | 4.0 | 4.5 | 3.0 | 3.0 | 4.0 | 3.0 | 3.0 | 4.0 |
| Refreshing feel | | 1.3 | 1.5 | 1.6 | 1.1 | 1.5 | 1.6 | 1.9 | 2.1 | 1.7 | 1.2 | 2.0 | 1.3 | 1.1 | 4.2 |
| Stuffy feel | | 1.1 | 1.1 | 1.5 | 0.9 | 1.3 | 1.4 | 1.5 | 2.0 | 1.5 | 1.0 | 1.7 | 1.2 | 0.9 | 4.0 |

With the three-dimensional knitted fabrics of Examples 1 to 11 which had stitch densities of 11,500 to 20,000, as shown in Table 1, napping caused by hook-and-loop fasteners (hook sides) was reduced, and the coolness and stuffiness resistance were also satisfactory.

In Example 4, since the number of stitches of connecting thread was ½ compared to Example 3, the air permeability from the connecting layer side toward the front layer knitted fabric of the three-dimensional knitted fabric was greater than Example 3, and the coolness and stuffiness resistance were more satisfactory.

In contrast, Comparative Examples 1 and 2, which had stitch densities of less than 11,500, despite exhibiting a satisfactory refreshing feel and stuffiness resistance, showed considerable napping by hook-and-loop fasteners, due to a greater open area ratio at a depth of 250 μm inward from the outer surface (uppermost surface layer).

Comparative Example 3 had excessively high stitch density, and therefore even though napping by hook-and-loop fasteners was reduced, the air permeability from the back layer knitted fabric through the front layer knitted fabric of the three-dimensional knitted fabric and the air permeability from the connecting layer side through to the front layer knitted fabric were both low, and the coolness and stuffiness resistance were also inferior.

Example 9, which had a relatively small opening size for the mesh structure, exhibited more satisfactory napping by hook-and-loop fasteners compared to Example 10.

INDUSTRIAL APPLICABILITY

The surface covering material of the invention can be suitably used as a seat to be placed on a cushion member such as a urethane pad of a seat in a vehicle or furniture, or stretched over a sheet frame, or as a surface covering material to be used for upholstery in a vehicle door trimming, ceiling, armrest or instrument panel, as a material having a high cooling property and stuffiness resistance while also inhibiting napping generation even when the surface is rubbed by hard protrusions such as the hook sections of hook-and-loop fasteners.

REFERENCE SIGNS LIST

1 Adjacent stitch
2 Adjacent stitch
3 Opening
K Opening size

The invention claimed is:

1. A surface covering material constructed from a three-dimensional knitted fabric that includes
- a front layer knitted fabric,
- a back layer knitted fabric, and
- a connecting layer comprising a connecting thread connecting the front layer knitted fabric and back layer knitted fabric,
- wherein an outer surface of the front layer knitted fabric is a side configured to contact with a human body, and a stitch density of the front layer knitted fabric is 13,000 to 19,000,
- the front layer knitted fabric of the three-dimensional knitted fabric includes a mesh structure formed by a yarn knitting process wherein a yarn supply method for the yarn knitting process has a threading arrangement of 1-in, 1-out plus 1-out, 1-in, or 2-in, 2-out plus 2-out, 2-in when supplying yarn from at least two guide combs, and the mesh structure has one of the knitted structures selected from the group consisting of:

Pattern 1:
L1: 1011/2322/(1-in, 1-out)
L2: 2322/1011/(1-out, 1-in), and
Pattern 2:
L2: 1011/2344/6766/5433/(2-in, 2-out)
L3: 6766/5433/1011/2344/(2-in, 2-out),
wherein L1, L2 and L3 are guide combs forming the mesh structure,
sizes of openings of the mesh structure are 0.3 mm to 2.5 mm, and
an open area ratio at a depth of 250 μm inward from the outer surface of the front layer knitted fabric of the three-dimensional knitted fabric is 15% to 70%.

2. The surface covering material according to claim 1, wherein the stitch density of the front layer knitted fabric is 14,000 to 19,000.

3. The surface covering material according to claim 1, wherein an air permeability from a connecting layer side between the front layer knitted fabric and the back layer knitted fabric of the three-dimensional knitted fabric, toward the front layer knitted fabric, is 33 cc/cm$^2$/sec or greater.

4. The surface covering material according to claim 3, wherein the air permeability from the connecting layer side, between the front layer knitted fabric and the back layer knitted fabric of the three-dimensional knitted fabric, toward the front layer knitted fabric, is 40 cc/cm$^2$/sec or greater.

5. The surface covering material according to claim 4, wherein the air permeability from the connecting layer side between the front layer knitted fabric and the back layer knitted fabric of the three-dimensional knitted fabric, toward the front layer knitted fabric, is 50 cc/cm$^2$/sec or greater.

6. The surface covering material according to claim 1, wherein an air permeability from the connecting layer side between the front layer knitted fabric and the back layer knitted fabric of the three-dimensional knitted fabric, toward the front layer knitted fabric, is 400 cc/cm$^2$/sec or lower.

7. The surface covering material according to claim 1, wherein a number of stitches of a connecting thread knitted into the front layer knitted fabric of the three-dimensional knitted fabric is ¼ to ½ of a total number of stitches in the front layer knitted fabric.

8. The surface covering material according to claim 1, wherein the front layer knitted fabric of the three-dimensional knitted fabric is not piled.

9. The surface covering material according to claim 1, wherein a thickness of the three-dimensional knitted fabric is 2.5 mm to 12 mm.

10. The surface covering material according to claim 1, which is for a seat.

11. The surface covering material according to claim 1, which is for a seat, and wherein an air permeability from a connecting layer side between the front layer knitted fabric and back layer knitted fabric of the three-dimensional knitted fabric, toward the front layer knitted fabric, is 400 cc/cm$^2$/sec or lower, and the front layer knitted fabric of the three-dimensional knitted fabric is not piled.

* * * * *